United States Patent [19]

Lemieux et al.

[11] Patent Number: 4,860,889

[45] Date of Patent: Aug. 29, 1989

[54] UNIVERSAL GOLF CLUB SEPARATOR

[76] Inventors: André Lemieux, 922 Charette, Chambly, Quebec, Canada, J3L 3E3; Gabriel Charland, 923 St-Jean, Chambly, Quebec, Canada, J3L 2W2

[21] Appl. No.: 222,074

[22] Filed: Jul. 20, 1988

[51] Int. Cl.[4] ..... A63B 55/00

[52] U.S. Cl. ..... 206/315.6; 220/22

[58] Field of Search ..... 206/315.2–315.8; 220/22, 22.1, 22.3, 22.5; 211/70.2; 248/96; 280/646, DIG. 6

[56] References Cited

U.S. PATENT DOCUMENTS 4,130,153 12/1978 Zopf ..... 206/315.6

4,155,387 5/1979 Costa ..... 206/315.6

*Primary Examiner*—Sue A. Weaver

[57] ABSTRACT

A separating plate for maintaining the handles of golf clubs in relatively spaced substantially parallel positions into a golf bag. It includes first to fourth rigid planar sections which are joined to form a generally circular assembly, each section having at least one through-bore adapted to be freely engaged by the handle of a golf club including the grip and ferrule thereof. The first and second sections are opposite to each other and include inwardly projecting legs each having a lengthwise slit or a few spaced bores adapted to be engaged by a bolt and adjustably locked by a nut. By spreading apart the first and second sections into the golf bag mouth, one can abut same thereagainst, and thereafter lock same in position with the bolt and nut to frictionally immobilize the separator therein. The first and second sections have lengthwise ridges on their side edges, and the third and fourth sections have lengthwise grooves on their side edges matingly engageable by the ridges for radial displacement of the latter two sections relative to the former two sections, wherein the sections are slidingly interconnected about a common plane.

14 Claims, 6 Drawing Sheets

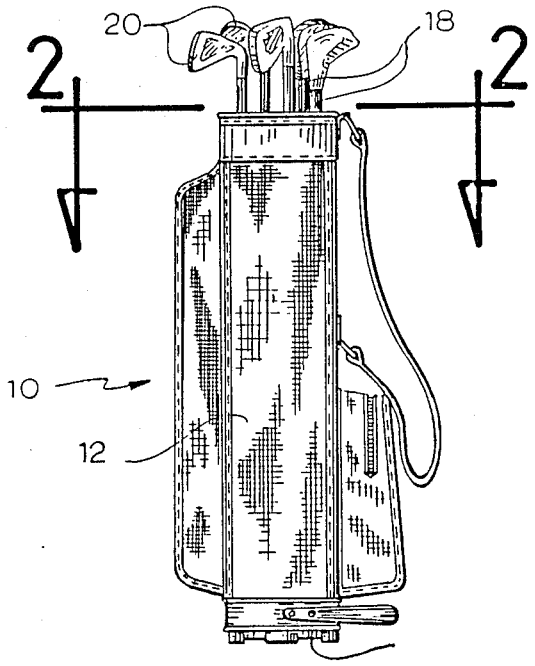
Fig.1
Fig.2a
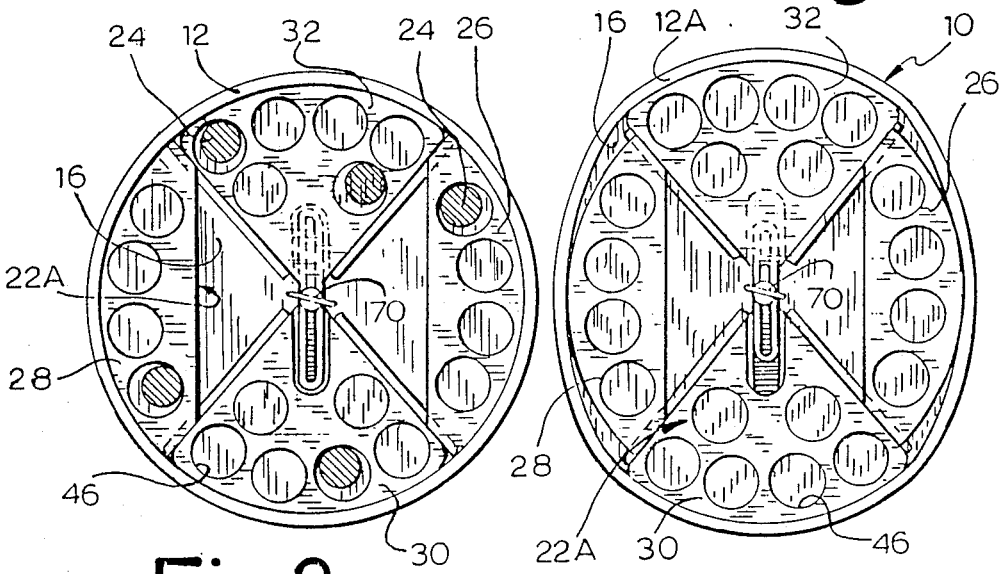
Fig.2

UNIVERSAL GOLF CLUB SEPARATOR

FIELD OF THE INVENTION

This invention pertains to accessories for golfers.

BACKGROUND OF THE INVENTION

In industrial countries, golf club separators for golf club bags are known, of which some models are already available on the market. Such separators usually consist of a circular plate having a number of through-bores, the plate being frictionally mounted to the mouth of the golf club bag and the through-bores adapted to be engaged by the handle (ferrule first) of the club. The separators are designed to protect the golf club heads against each other, i.e. to prevent one striking the others during transportation. An unsolved problem is that such separators cannot adapt to golf club bags having different diameters and shapes of (upper) mouths.

OBJECT OF THE INVENTION

The object of the invention is therefore to address the problem outlined in the above background of the invention.

SUMMARY OF THE INVENTION

In accordance with the stated objects of the invention, there is disclosed a separator member for maintaining the handles of golf clubs in relatively spaced substantially parallel positions into a golf bag. The separator member comprises: first to fourth rigid planar sections which are joined to form a generally circular assembly, each section having at least one through-bore adapted to be freely engaged by the handle of a golf club including the grip and ferrule thereof, said first and second sections being opposite to each other; said means for joining said sections including connector means slidingly interconnecting said sections about a common plane; and adjustment means for adjusting the spacing between said first and second opposite sections and adapted to coact with said connector means. When said assembly is mounted into the golf bag mouth, said adjustment means may be actuated to bias said first and second sections to releasably frictionally engage the inner wall of the bag defined by said mouth.

Advantageously, the connector means includes guide means, to provide for radial coplanar displacement of said third and fourth sections concurrently with corresponding displacement of said first and second sections, about the same plane, upon actuation of said adjustment means. This radial displacement of the third and fourth sections should be in a radial direction transverse to said first and second sections.

In one embodiment of the invention, the guide means defines lengthwise projections, extending on the side edges of said first and second sections, and lengthwise cavities, extending on the side edges of said third and fourth sections, the latter projections and cavities adapted to slidingly and matingly interengage in pairs. Each of said guide means projections could form a cross-sectionally quadrangular tongue and each of said guide means cavities could form a cross-sectionally U-shaped groove, the grooves slidingly engageable by the tongues in pairs.

Profitably, said adjustment means includes an elongated leg radially inwardly extending from a point located midway of the shape of each of said first and second sections, the thickness of each leg having at the most half the thickness of said first and second sections, the two legs slidingly applied against each other. There would be further included a locking member forming part of said adjustment means, to transversely releasably interlock said legs about an intermediate section thereof. Each said leg could include a lengthwise slit adapted to register with that of the second leg, and said locking member could include a bolt member engageable through both said slits and a nut to be screwed to said bolt member against one said leg. Also, each said leg could include a knurled underface adapted to frictionally interact with the knurled underface of the other corresponding leg.

It is envisioned that the first and second rigid sections each includes a half-thickness cavity in register with the corresponding said leg, and slidingly engageable by the leg of the other said first or second section.

In a second embodiment of the invention, each said leg could include a number of small apertures, a selected one of said apertures from one leg adapted to register with a selected one of said apertures from the other leg, and said locking member could be the bolt member engageable through both said selected apertures from the two legs and the nut to be screwed to said bolt member against one said leg.

Preferably, the first and second rigid sections each includes a half-thickness channel in register with the corresponding said leg, and slidingly engageable by the leg of the other said first or second section.

Preferably also, each of said legs defines a flat tip.

A few bevelled ear lugs are most profitably provided about an arcuate outer edge of each said first and second sections, or alternately of each said third and fourth sections, for gripping against the golf bag mouth inner wall.

BRIEF DESCRIPTION OF THE DRAWINGS

FIG. 1 is a side elevational view of a conventional golf club bag, being provided with the golf club separator of the invention (which is hidden) about the mouth thereof;

FIG. 2 is a partly sectional top plan view, at an enlarged scale, of a first embodiment of golf club separator and of the golf club bag, taken through the golf clubs along line 2—2 of FIG. 1;

FIG. 2*a* is a top plan view of said first embodiment of separator and of the mouth of the golf club bag, but with the bag being of cross-sectionally oval shape rather than of cylindrical shape;

DETAILED DESCRIPTION OF PREFERRED EMBODIMENTS OF THE INVENTION

Figure 3:
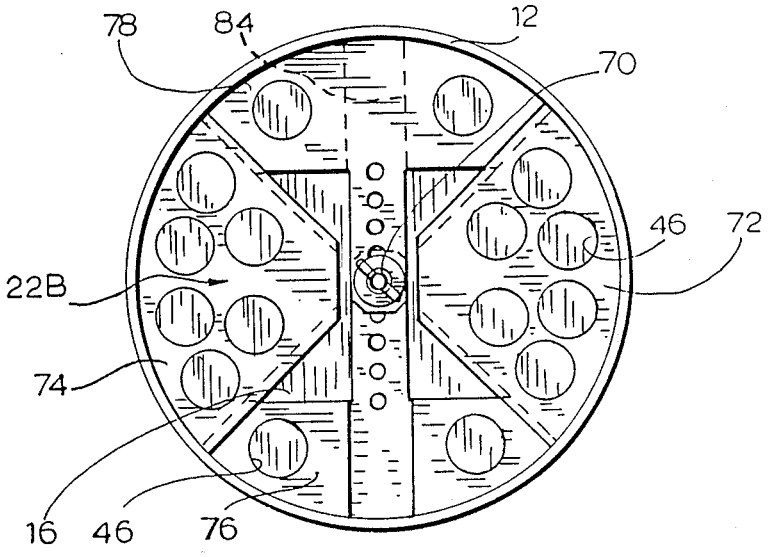
FIG. 3 is a top plan view of a second embodiment of golf club separator, being mounted to the mouth of a cylindrical bag.
Figure 3A:
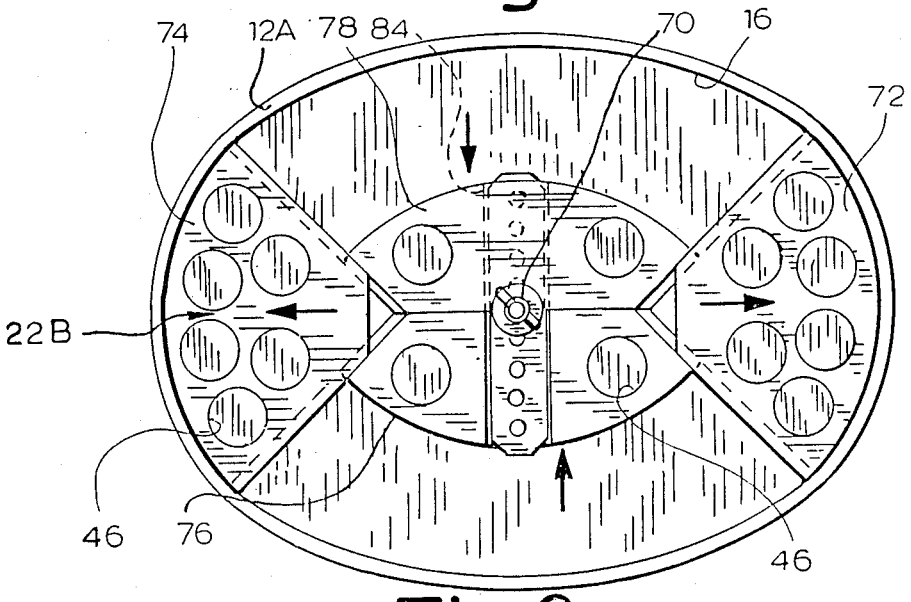
FIG. 3*a* is a top plan view of said second embodiment of separator, mounted to the mouth of a cross-sectionally annular bag which is much larger than the one shown in FIG. 3.

Golf club bag 10 (FIG. 1) defines a main elongated body 12 having a bottom rigid flooring 14 and a top mouth 16 for engagement by golf clubs 18 with their transverse heads 20 projecting outwardly from mouth 16. At rest, bag 10 may stand upright, on its rigid flooring 14.

Figure 4:
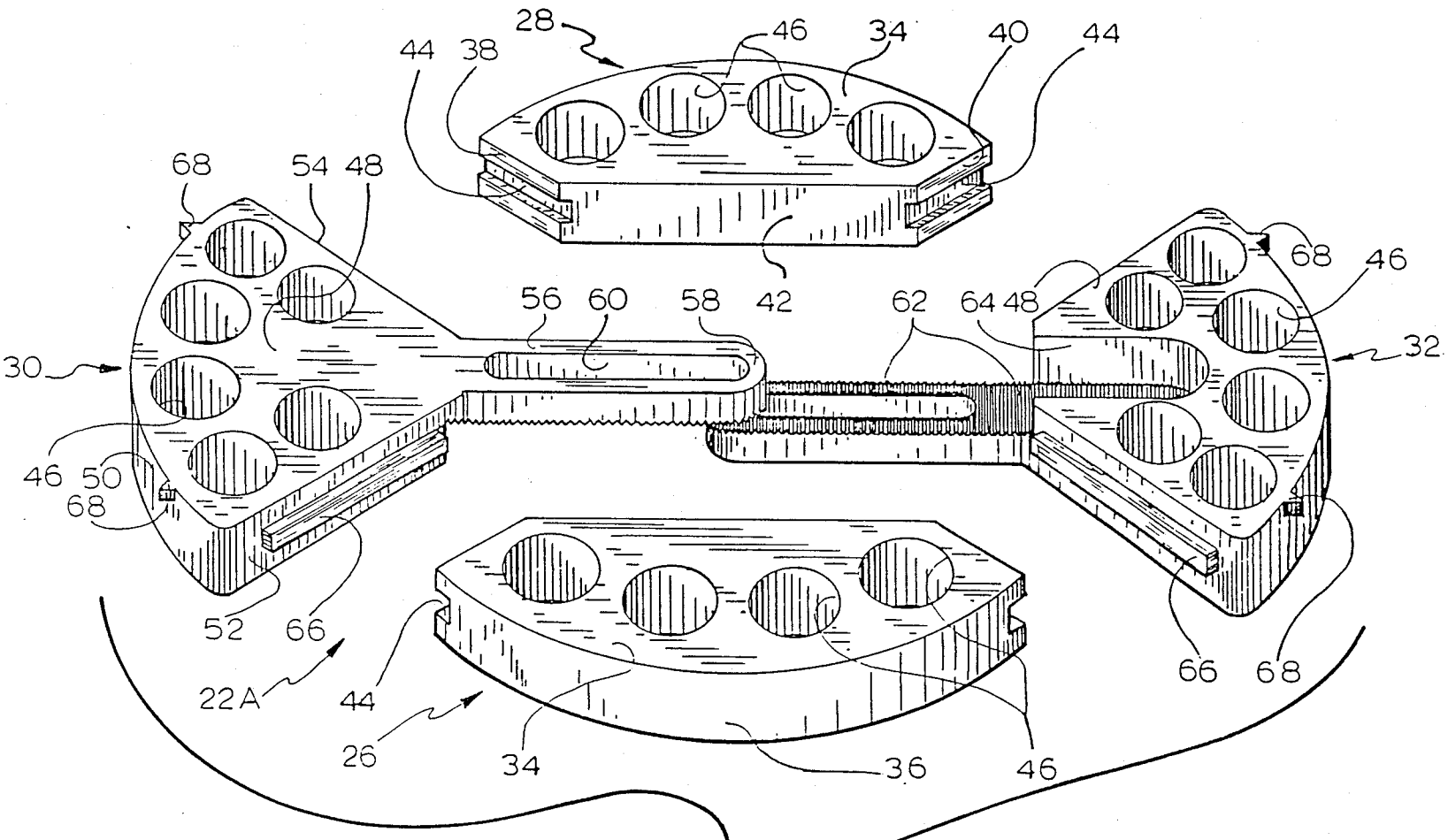
FIGS. 4, 5, and 6 are exploded perspective views, at an enlarged scale relative to FIG. 3*a*, of the first embodiment, the second embodiment, and the third embodiment of golf club separators, respectively.
Figure 5:
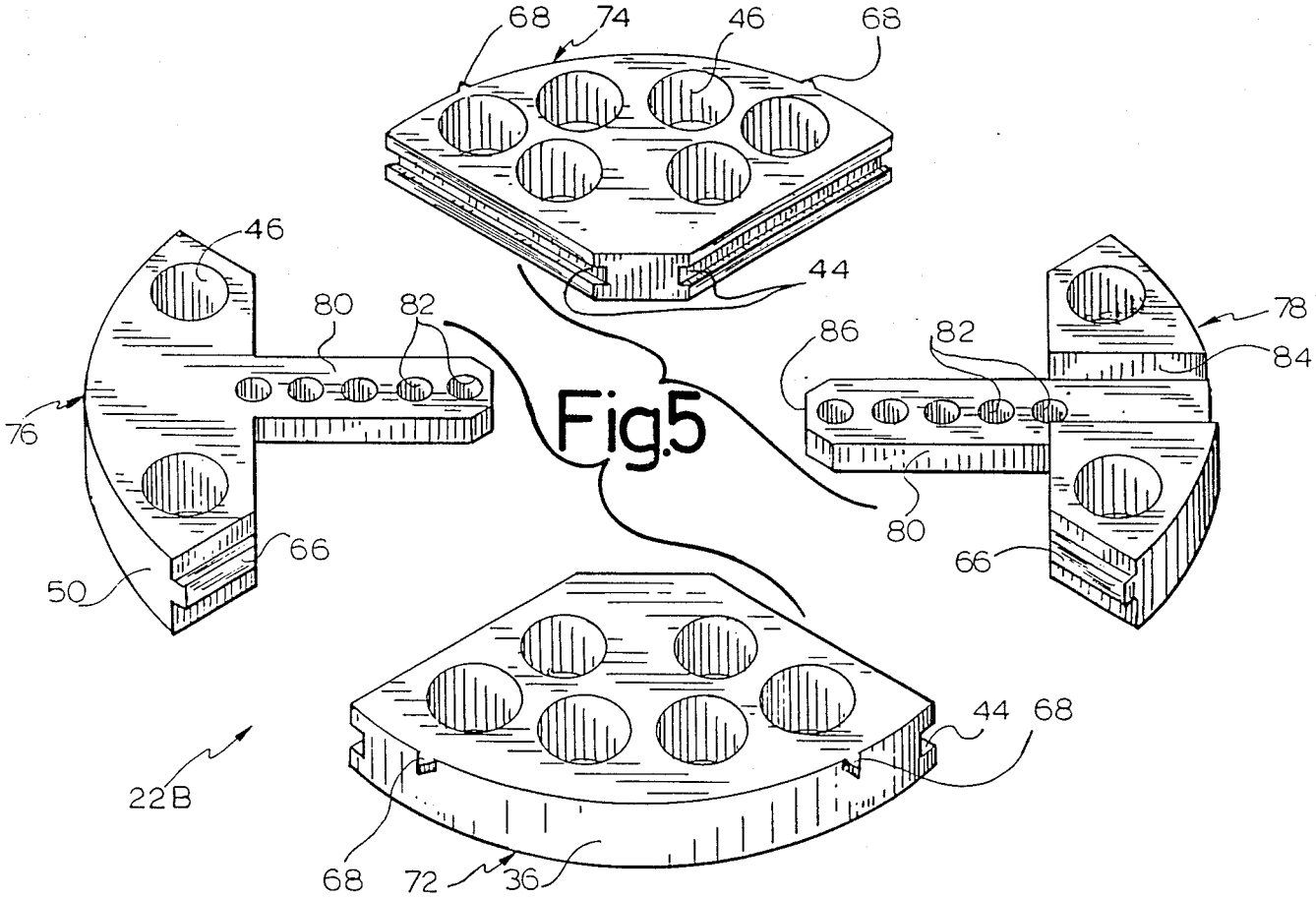
Figure 6:
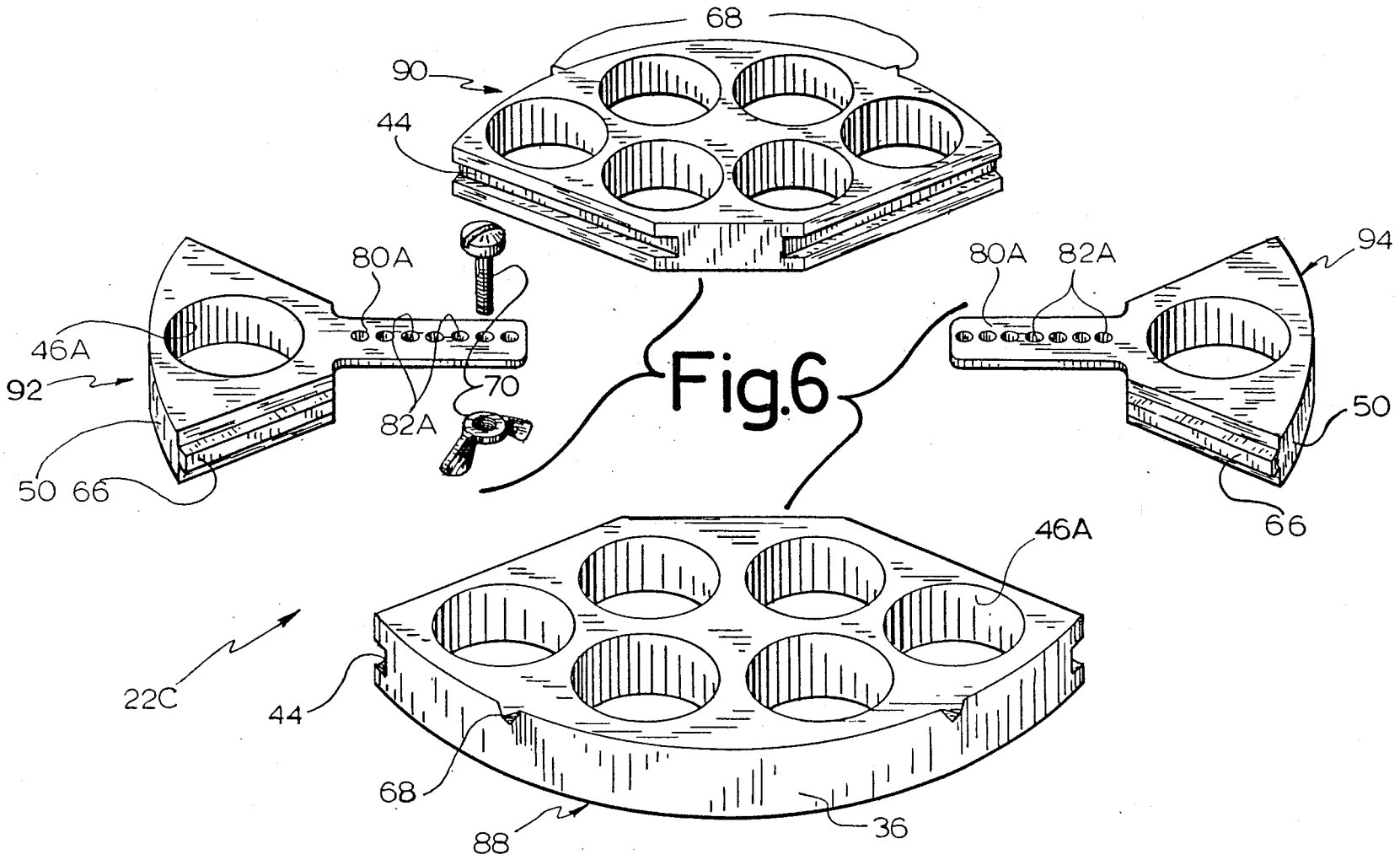

In accordance with the teachings of the invention, there is provided a separator member 22*a*, 22*b* or 22*c*, see FIGS. 4–6, about the mouth 16 (FIGS. 2–3) of golf bag 10, for separating the elongated handle 24 of each golf club 18 relative to the others. The separator member is adapted to substantially if not exactly conform to the shape of the inner area of the mouth 16, so as to be frictionally releasably immobilized thereabout; accordingly, oval shaped bags 12A (FIG. 2*a*) are also envisioned to benefit from the same said separator member, which form could be adjusted in view thereof.

In the first embodiment of separator shown at FIG. 4 and denoted 22A, there is defined four sections 26, 28, 30, 32, adapted to interlock with each other. Sections 26 and 28 are substantially identical, each forming a plate 34. More particularly, each plate 34 defines an arcuate outer edge 36, two short radially-inwardly extending side edges 38, 40 and a flat elongated inner edge 42 tangent to the radius of a virtual circle defined by said arcuate outer edge 36. Each side edge 38, 40 includes a cross-sectionally U-shaped groove 44. Each plate 34 includes a number of large throughbores 46, such as four as illustrated in FIG. 4.

In fact, each section 26, 28, 30, 32 includes a number of such bores 46. Through bores 46 can be straight bores, or frusto-conical ones (with the larger end at the top), or most preferably defining a generatrix of convex shape. Each bore 46 is designed to be engaged by a single golf club 18, with the grip thereof (opposite head 20) being the leading edge. A somewhat curved bore 46 (frusto-conical, or defining a generatrix of convex shape) is preferable, since the grip of the golf club 18 is diametrically larger than its handle 24, and the ferrule of the golf club grip is diametrically larger than the grip: one needs to lift the golf club high enough to bring the latter above the bag mouth 16 in order to engage same into the golf bag 12, and this has to be done with the club in substantially exactly vertical position, otherwise the handle 24 will "lock" at an intermediate section into the selected separator bore 46 (because of the ferrule bulge), and the separator will be forcibly induced to disengage from the bag mouth 16. A "curved" rather than a straight bore 46 will lessen the possibility of such "locking" of the golf club therein.

Returning to the embodiment of separator 22A in FIG. 4, parts 30, 32, will be detailed. Each section 30, 32 defines a thick plate 48, with an arcuate outer edge 50, two elongated radially inwardly extending side edges 52, 54, and a radially inturned elongated projection 56 at the apex of plate 48. Each plate 48 has a number of bores 46, e.g. six. Projection 56 defines a thickness which is half that of plate 48. Projection 56 includes a curved tip 58, a lengthwise slit 60, and a knurled underface 62. Plate 48 further includes a radial U-shaped cavity 64 at its apex, about the free half-thickness portion thereof in register with projection 56. Each side edges 52, 54, defines a cross-sectionally quadrangular, lengthwise projection or ridge 66. Each ridge 66 is slightly shorter than its corresponding side edge, but much longer relatively to each groove 44. Also, a few bevelled ear lugs 68 are provided about the outer edges 50 of each section 30, 32, of the separator.

It can now be understood how sections 26–32 interlock; ridges 66 slidingly engage in grooves 44, the knurling 62 of the underface of the projection 56 from section 30 gripping with the knurling 62 of the underface of the projection 56 from the (relatively inverted) section 32, and tip 58 of projection 56 from section 30 comes to abut against the inner base of cavity 64 of section 32 (and vice-versa). Sections 30, 32, may be locked in place by a butterfly screw and nut assembly 70, see FIGS. 2–2*a*. Screw 70 engages both slits 60, 60, to lock both corresponding projections 56, 56 of the sections 30, 32 together.

Then, separator 22A can be inserted into the bag mouth 16. Bevelled ear lugs 68 will grip the inner wall of the upper section of the bag 12, about mouth 16, to frictionally immobilize the separator 22A thereabout.

The heart of the invention lies in the fact that each embodiment of separator, including separator embodiment 22A, includes means for adjustment in its diametral dimensions, to suit mouths of bags 12, 12A of various diameters and shapes, see FIGS. 2, 2*a*. This is done by manually displacing sections 30–32 away from each other, while sections 26–28 remain substantially in a relatively constant position, since ridges 66 will lengthwisely slide in mating grooves 44.

Hence, in operation, separator 22A is first assembled outside of the bag 12 or 12*a* by interlocking sections 26 to 32 via projections 56 and grooves 44 and ridges 66, wherein sections 30 and 32 are closest to each other. Butterfly screw 70 is tightened moderately. Then, assembled separator 22A is manually engaged into the mouth 16 of the (empty) golf bag 12, and retained thereabout. Bolt 70 is then untightened (but not removed) to allow the manual spreading apart of sections 30, 32 until their arcuate side edges 50 abut against the inner wall of the upper section of the bag 12 (i.e. mouth 16). During this last-mentioned step, bolt 70 will slide along the lengthwise slit 60 of both projections 56 of sections 30–32, wherein sections 30, 32 will move in exactly opposite directions (i.e. at 180 degrees) of each other. Also, during this last-mentioned step, ridges 66 will slide lengthwisely through and into mating grooves 44, whereby the relative position of sections 26, 28, will remain substantially unchanged. The last step consists in tightening butterfly screw 70 in place so that bevelled ear lugs 68 positively grip the inner wall of bag 12, to prevent upward/downward disengagement of the separator 22A relative to the golf bag mouth 16. Hence, separator 22A is temporarily integral to the golf bag 12.

The golfer may then insert each one of his/her golf clubs 18 in a selected bore 46 of the separator 22A, and thereafter roll (on his/her wheeled buggy) the bag to the starting green to begin the game. The heads 20 will thus be protected from each other, since they will not be induced to fall against each other because they will be properly spaced. Separator 22*a* is easily removed from the bag 12 whenever desired.

The second embodiment of separator is shown in exploded view in FIG. 5 and is denoted 22B. Again, separator 22B is made up of four parts, denoted 72, 74, 76 and 78. Each section 72, 74 resembles the sections 26, 28 of the first embodiment 22A of the separator: it has a number of large through-bores 46, it defines lengthwise side edge grooves 44 and it defines an arcuate outer edge 36. Similarly, each section 76, 78 resembles sections 30, 32 of separator 22A; it has lengthwise side edge cross-sectionally quadrangular ridges 66, bores 46, an arcuate outer edge 50, and a radially inwardly extending elongated half-thickness projection 80 (detailed below).

However, in this second embodiment, the side edges of sections 72, 74 are much longer than that of sections 76, 78 and therefore, the lengthwise cross-sectionally U-shaped grooves 44 are relatively much longer than their mating ridges 66. Ridges 66 make up the whole length of the side edges of sections 76–78. Accordingly, ear lugs 68 are mounted to edges 36 rather than edges 50, the number of bores 46 is larger in sections 72, 74 (six each) than in sections 76, 78 (two each). Also, in this second embodiment, each projection 80 includes a number of small apertures 82, any one of which is adapted to register with a selected aperture of the other projection 80 for releasable locking engagement by butterfly screw or bolt 70. Due to the relatively small size of sections 76, 78 each cavity 64 of the first embodiment is replaced by a half-thickness groove 84. The tip 86 of each projection 80 is flat, so as to possibly directly frictionally abut against the inner wall of the golf bag 12 upon full respective engagements of projections 80 into their opposite corresponding grooves 84.

Of course, the lengthwise slit 60 and knurling 62 features of the first embodiment of the separator 22A could be used as well in the second embodiment of the invention, 22B.

Figure 7:
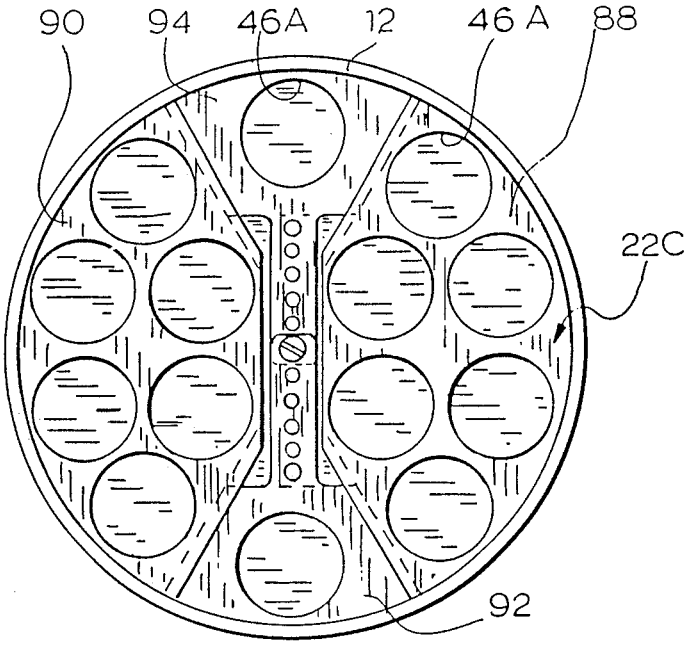
FIG. 7 is a top plan view of said third embodiment of the invention, being mounted to the mouth of a cylindrical golf club bag.
Figure 7A:
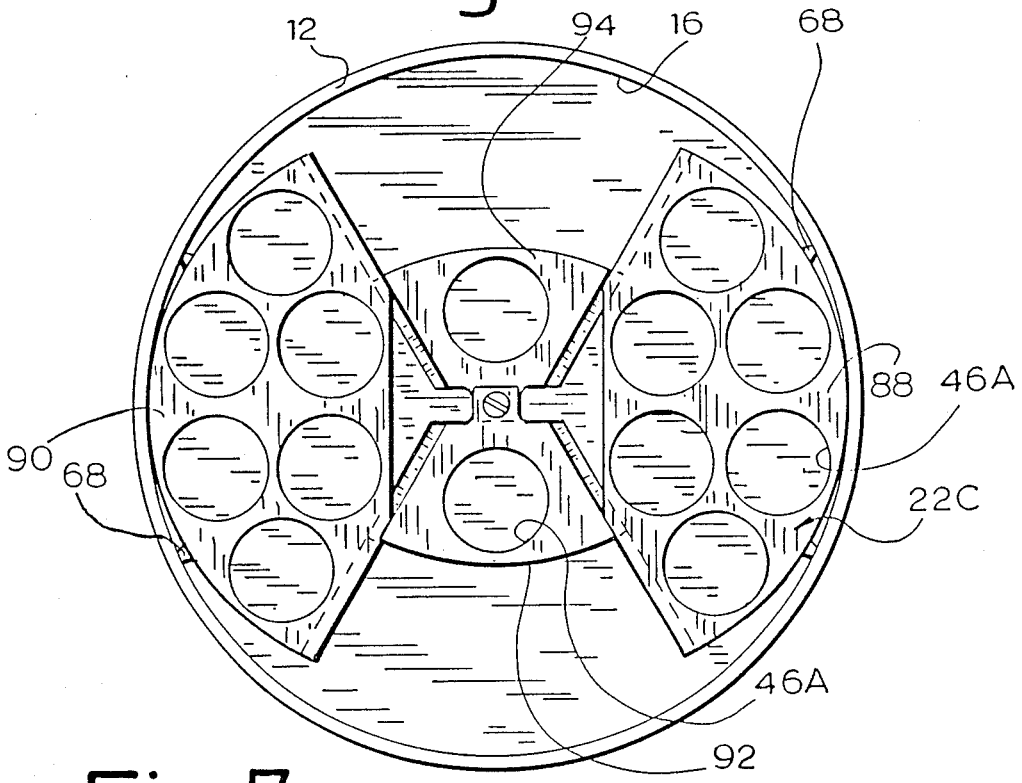
FIG. 7*a* is a top plan view of said third embodiment of golf club separator, being mounted to the mouth of a cylindrical golf club bag which is of much larger dimensions than that of FIG. 7.

The third embodiment of separator 22C is shown in FIGS. 6 and 7. Separator 22C still consists of four sections 88, 90, 92, and 94. Sections 88 and 90 are similar to sections 72, 74, of the second embodiment but for their overall dimensions and for their through-bores 46A which are relatively much larger. Accordingly, sections 92 and 94 are of smaller dimensions relative to corresponding sections 76, 78 and each includes a single large through-bore 46A. Also, projections 80A are much thinner than projections 80, their small apertures 82A being diametrically smaller than corresponding apertures 82, and in view of the small dimensions of sections 92 and 94, no cavity 64 or groove 84 is required. The same separator 22C can fit bags 12 and 12B of different sizes and also of different shapes.

What we claim is:

1. A separator member for maintaining the handles of golf clubs in relatively spaced substantially parallel positions into a golf bag, comprising: first to fourth rigid planar sections including means for joining said sections to form a generally circular assembly, each of said sections having at least one through-bore adapted to be freely engaged by the handle of a golf club including the grip and ferrule thereof, said first and second sections being opposite each other; said means for joining said sections including connector means slidingly interconnecting said sections about a common plane; and adjustment means for adjusting the spacing between said first and second opposite sections and adapted to coact with said connector means, whereby when said assembly is mounted into the golf bag mouth, said adjustment means may be actuated to bias said first and second sections to releasably frictionally engage the inner wall of the bag defined by said mouth.

2. A separator member for golf clubs as defined in claim 1, further including guide means, forming part of said connector means, to provide for radial coplanar displacement of said third and fourth sections concurrently with corresponding displacement of said first and second sections, about the same plane, upon actuation of said adjustment means.

3. A separator member for golf clubs as defined in claim 2, wherein said radial displacement of the third and fourth sections is in a radial direction transverse to said first and second sections.

4. A separator member for golf clubs as defined in claim 2, wherein said guide means defines lengthwise projections, extending on the side edges of said first and second sections, and lengthwise cavities, extending on the side edges of said third and fourth sections, the latter projections and cavities adapted to slidingly and matingly interengage in pairs.

5. A separator member for golf clubs as defined in claim 4, wherein each of said guide means projections forms a cross-sectionally quadrangular tongue and each of said guide means cavities forms a cross-sectionally U-shaped groove, the grooves slidingly engageable by the tongues in pairs.

6. A separator member for golf clubs as defined in claim 1, wherein said adjustment means includes an elongated leg radially inwardly extending from a point located midway of the shape of each of said first and second sections, the thickness of each leg having at the most half the thickness of said first and second sections, the two legs slidingly applied against each other; further including a locking member forming part of said adjustment means, to transversely releasably interlock said legs about an intermediate section thereof.

7. A separator member for golf clubs as defined in claim 6, wherein each said leg includes a lengthwise slit adapted to register with that of the second leg, and said locking member includes a bolt member engageable through both said slits and a nut to be screwed to said bolt member against one said leg.

8. A separator member for golf clubs as defined in claim 7, wherein each said leg includes a knurled face adapted to frictionally interact with the knurled face of the other corresponding leg.

9. A separator member for golf clubs as defined in claim 7, wherein said first and second rigid sections each includes a half-thickness cavity in register with the corresponding said leg, and slidingly engageable by the leg of the other said first or second section.

10. A separator member for golf clubs as defined in claim 6, wherein each said leg includes a number of small apertures, a selected one of said apertures from one leg adapted to register with a selected one of said apertures from the other leg, and said locking member includes a bolt member engageable through both said selected apertures from the two legs and a nut to be screwed to said bolt member against one said leg.

11. A separator member for golf clubs as defined in claim 10, wherein said first and second rigid sections each includes a half-thickness channel in register with the corresponding said leg, and slidingly engageable by the leg of the other said first or second section.

12. A separator member for golf clubs as defined in claim 11, wherein each of said legs defines a flat tip.

13. A separator member for golf clubs as defined in claim 1, further including a few bevelled ear lugs, being provided about an arcuate outer edge of each of said first and second sections, for gripping action against the golf bag mouth inner wall.

14. A separator member for golf clubs as defined in claim 1, further including a few bevelled ear lugs, being provided about an arcuate outer edge of each of said third and fourth sections, for gripping action against the golf bag mouth inner wall.

* * * * *